US006907705B2

(12) United States Patent
Dean et al.

(10) Patent No.: US 6,907,705 B2
(45) Date of Patent: Jun. 21, 2005

(54) REVERSIBLE WALL BLOCK, BLOCK WALL, AND METHOD OF WALL CONSTRUCTION

(75) Inventors: Jeffrey M. Dean, Tampa, FL (US); Jeffrey A. Mattox, Tampa, FL (US)

(73) Assignee: Innovative Concrete Solutions, Inc., Tampa, FL (US)

( * ) Notice: Subject to any disclaimer, the term of this patent is extended or adjusted under 35 U.S.C. 154(b) by 64 days.

(21) Appl. No.: 10/369,692

(22) Filed: Feb. 21, 2003

(65) Prior Publication Data

US 2004/0163353 A1 Aug. 26, 2004

(51) Int. Cl.[7] ..... E04B 5/04

(52) U.S. Cl. ..... 52/608; 52/604; 52/609; 52/745.1; 405/284; 405/286; D25/118

(58) Field of Search ..... 52/596, 604, 608, 52/609, 311.1, 745.1, 745.13; 405/284, 286; D25/113–118

(56) References Cited

U.S. PATENT DOCUMENTS

| | | | | | |
|---|---|---|---|---|---|
| 1,855,987 | A | * | 4/1932 | Rammer | 52/608 |
| 2,942,115 | A | | 6/1960 | O'Connell | |
| D213,686 | S | | 4/1969 | Frehner | |
| D301,063 | S | * | 5/1989 | Risi et al. | D25/113 |
| 4,996,813 | A | | 3/1991 | Kliethermes, Jr. et al. | |
| 5,249,950 | A | | 10/1993 | Woolford | |
| 5,535,568 | A | * | 7/1996 | Quinn | 52/608 |
| D386,265 | S | | 11/1997 | Ellington | |
| 5,943,827 | A | | 8/1999 | Okerlund | |
| D420,711 | S | | 2/2000 | Glickman | |
| D426,588 | S | | 6/2000 | Glickman | |
| D429,006 | S | * | 8/2000 | Price et al. | D25/113 |
| 6,233,897 | B1 | | 5/2001 | Jurik | |
| 6,523,317 | B1 | * | 2/2003 | Bott et al. | 52/609 |
| 2002/0083657 | A1 | | 7/2002 | Mattox et al. | |

* cited by examiner

*Primary Examiner*—Laurie K. Cranmer
(74) *Attorney, Agent, or Firm*—Foley & Lardner LLP

(57) ABSTRACT

A wall block, system, and method for creating a straight and/or curved wall such that the front and back sides of the wall will have generally the same appearance. The block is asymmetrical and is designed to abut the ends of like blocks that are upright or inverted relative thereto.

32 Claims, 7 Drawing Sheets

REVERSIBLE WALL BLOCK, BLOCK WALL, AND METHOD OF WALL CONSTRUCTION

CROSS REFERENCE TO RELATED APPLICATIONS

This application is related to concurrently filed U.S. Design patent application Ser. No. 29/176,232, which is incorporated herein by reference.

BACKGROUND OF THE INVENTION

1. Field of the Invention

The present invention relates to blocks used in creating landscaping walls. More particularly, this invention relates to blocks which can be used to create a curved and/or a straight wall such that the wall has a substantially similar appearance on both the front and back sides thereof.

2. Description of the Related Art

Historically, there have been two types of landscaping walls: retaining walls and edging walls, both of which could be straight and/or curved. Retaining walls, which typically are exposed on only one side thereof, are easily designed so that the visible side is visually appealing. By way of contrast, edging walls typically are exposed on both sides thereof and, therefore, the owner must be concerned with the visual appearance of both sides of the wall.

To create a curved edging wall, oftentimes, straight blocks (also referred to as "stones") were angled with respect to each other. Unfortunately, as a result of this angling, one side of the wall would have grooves (often wedge or pie shaped) between the blocks whereas the other side of the wall would have no such grooves. As a result, the overall appearances of the front and back sides of the wall would be substantially different.

To solve this problem, curved blocks have been designed which create curved walls having front and back sides which appear substantially the same. However, when these blocks are arranged linearly (to create a straight wall), one side of the wall displays grooves between the blocks whereas the other side of the wall has no such grooves, i.e., these curved blocks have the same problem as the aforementioned straight blocks. As a result, these curved blocks can not be arranged to create a straight wall having front and back sides having substantially similar appearances.

To create a wall having curved and straight portions and having front and back sides which appear substantially similar, an owner had to purchase blocks having two different shapes, one for the straight portions and the other for the curved portions. Moreover, this required manufacturers to invest in costly molds to create both types of blocks.

Accordingly, what is needed is a block which: (a) can be used to create a curved and/or a straight wall; and (b) is designed so that a curved and/or straight wall incorporating a plurality of the blocks will have the same general appearance on the front and back sides thereof.

SUMMARY OF THE INVENTION

The invention herein encompasses multiple embodiments. A block according to the invention has a first side; a second side; a third side; a fourth side; a fifth side; a sixth side; a seventh side; and an eighth side. In this embodiment: (a) the first side joins the second side in an angle of $\alpha°$, (b) the second side joins the third side in an angle of $\alpha°$, (c) the third side joins the fourth side in an angle of $\delta°$, (d) the fourth side joins the fifth side in an angle of $\lambda°$, (e) the fifth side joins the sixth side in an angle of $\alpha°$, (f) the sixth side joins the seventh side in an angle $\alpha°$, (g) the seventh side joins the eighth side in an angle of $(270°-\alpha°)$, and (h) the eighth side joins the first side in an angle $(270°-\alpha°)$. In addition, $(\lambda°+\delta°+2(\alpha°))=540°$ and $(270°-\alpha°)\neq\delta°$.

The second side may be substantially equal in length to the sixth side. Additionally, or alternatively, the fourth side may be substantially equal in length to the eighth side.

The eighth side may be substantially perpendicular to the second and sixth sides.

The block may be formed from a material selected from the group consisting of stone, brick, concrete, ceramic, and clay.

Another aspect of the invention pertains to the relationship between adjacent like blocks. Each block includes a front face, a rear face opposite the front face, a right end, and a left end. The right end includes first, second, and third parts, the first part being connected at an angle to the front face, the second part being connected at an angle to the rear face, and the third part connecting the first and second parts; the third part is oriented substantially perpendicular to the front and rear faces. The left end also includes first, second, and third parts, the first part being connected at an angle to the front face, the second part being connected at an angle to the rear face, and the third part connecting the first and second parts; the third part of the left end is oriented at an oblique angle to the front and rear faces. The third part of the right end of a first block is adapted to abut the third part of the left end of a like second block so that: (a) the front faces of the first and second blocks are angled, (b) the rear faces of the first and second blocks are angled, (c) a first groove is defined between first part of the right end of the first block and the first part of the left end of the second block, and (d) a second groove is defined between the second part of the right end of the first block and the second part of the left end of the second block.

The third part of the right end of the first block may be adapted to abut the third part of the right end of a like third block so that: (a) the front face of the first block is substantially aligned with the front face of the third block, (b) the rear side of the first block is substantially aligned with the rear face of the third block, (c) a third groove is defined between the first part of the right end of the first block and the first part of the right end of the third block, and (d) a fourth groove is defined between the second part of the right end of the first block and the second part of the right end of the third block.

The third part of the left end of the first block may be adapted to abut the third part of the left end of a like third block so that: (a) the front face of the first block is substantially aligned with the rear face of the third block, (b) the rear face of the first block is substantially aligned with the front face of the third block, (c) a third groove is defined between the front first part of the left end of the first block and the second part of the left end of the third block, and (d) a fourth groove is defined between the second part of the left end of the first block and the first part of the left end of the third block.

The first and second grooves may have appearances which are substantially similar. Alternatively, or additionally, the third and fourth grooves may have appearances which are substantially similar.

The blocks may be formed from a material selected from the group consisting of stone, brick, concrete, ceramic, and clay.

The front face of each block may be substantially parallel to the rear face.

Another aspect of the invention pertains to an asymmetrical landscaping block for abutting end-to-end placement with like blocks. This asymmetrical block includes a top face, a bottom face, a front face, a rear face, a left end, and a right end. The left end includes a first abutting face disposed at an angle $\epsilon$ with respect to a medial vertical plane through the left and right ends. The right end includes a second abutting face disposed at an angle $\eta$ with respect to the medial vertical plane, wherein $\epsilon \neq \eta$. The first abutting face of the left end of a first block is adapted to abut the second abutting face of the right end of a like second block so that the front faces of the first and second blocks are angled, so that the rear faces of the first and second blocks are angled, so that a first groove is defined between front face of the first block and the front face of the second block, and so that a second groove is defined between the rear face of the first block and the rear face of the second block.

The first and second grooves may have appearances which are substantially similar.

The front face and the rear face may be substantially parallel. Additionally, or alternatively, the first abutting face may be substantially perpendicular to the front and rear faces.

The left end may further include a first part which connects the first abutting face to the front face and a second part which connects the first abutting face to the rear face. Moreover, the right end may further include a first part which connects the second abutting face to the front face and a second part which connects the second abutting face to the rear face. Additionally, or alternatively, the first groove may be defined between the first part of the left end of the first block and the first part of the right end of the second block. Similarly, the second groove may be defined between the second part of the left end of the first block and the second part of the right end of the second block.

The first abutting face may be substantially equal in length to the second abutting face. Additionally, or alternatively, the front face may be substantially equal in length to the rear face.

The block may be formed from a material selected from the group consisting of stone, brick, concrete, ceramic, and clay.

Another aspect of the invention involves a system for constructing a landscaping wall from a plurality of blocks. This system includes: a first block and a second block substantially similar in shape to said first block. The first block includes: a top face, a bottom face, a front face, a rear face, a left end, and a right end. The left end includes a first abutting face disposed at an angle $\epsilon$ with respect to a medial vertical plane through the left and right ends block. The right end includes a second abutting face disposed at an angle $\eta$ with respect to the medial vertical plane, wherein $\epsilon \neq \eta$. The first abutting face of the left end of a first block is adapted to abut the second abutting face of the right end of the second block so that the front faces of the first and second blocks are angled, so that the rear faces of the first and second blocks are angled, so that a first groove is defined between front face of the first block and the front face of the second block, and so that a second groove is defined between the rear face of the first block and the rear face of the second block.

The front and rear faces of the first block may be substantially parallel to each other. Additionally, or alternatively, the first abutting face of the first block may be substantially perpendicular to the front and rear faces thereof.

The left end of each block may further include a first part which connects the first abutting face to the front face and a second part which connects the first abutting face to the rear face. Moreover, the right end of each block may further included a first part which connects the second abutting face to the front face and a second part which connects the second abutting face to the rear face. Additionally, the first groove may be defined between the first part of the left end of the first block and the first part of the right end of the second block. In addition, the second groove may be defined between the second part of the left end of the first block and the second part of the right end of the second block.

The first abutting face and the second abutting face of each block may be substantially equal in length. Additionally, or alternatively, the front face and the rear face of each block may be substantially equal in length.

The first and second blocks may be formed from a material selected from the group consisting of stone, brick, concrete, ceramic, and clay.

The first and second grooves may have appearances which are substantially similar.

The invention also contemplates a method of constructing a wall having at least one straight portion and at least one curved portion. This method includes: (a) placing a first block in a predetermined position; (b) placing a second block in an end-to-end orientation with respect to the first block to create a first of the at least one straight portion, said second block having a shape which is substantially the same as the first block; and (c) placing a third block in an end-to-end orientation with respect to either the first or the second block to create a first of the at least one curved portion, said third block having a shape which is substantially the same as the first and second blocks. Further, a front side of a wall formed by the first, second, and third blocks has an appearance which is substantially similar to an appearance of a rear side of the wall formed by the first, second, and third blocks.

A first end of the wall may have an appearance which is substantially similar to an appearance of a second end of the wall.

These and other features, aspects, and advantages of the present invention will become more apparent from the following description, appended claims, and accompanying exemplary embodiment shown in the drawings.

BRIEF DESCRIPTION OF THE DRAWINGS

The accompanying drawings, which are incorporated in and constitute a part of the specification, illustrate various embodiments of the invention and together with the description, serve to explain the principles of the invention.

DETAILED DESCRIPTION

Figure 1A:
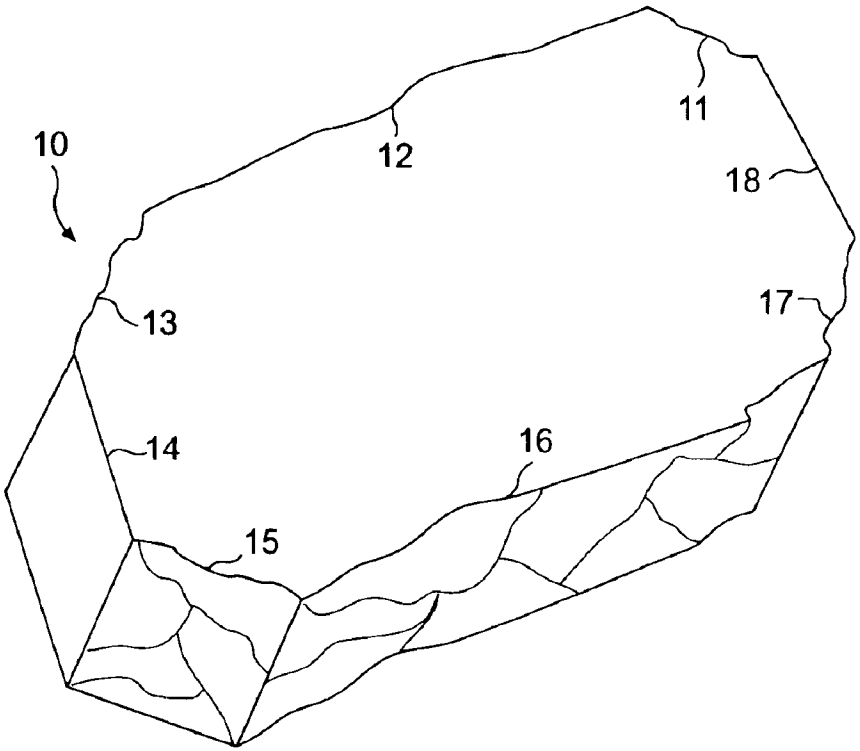
FIG. 1A is a perspective view of one embodiment of a block according to the present invention showing a first end thereof.
Figure 1B:
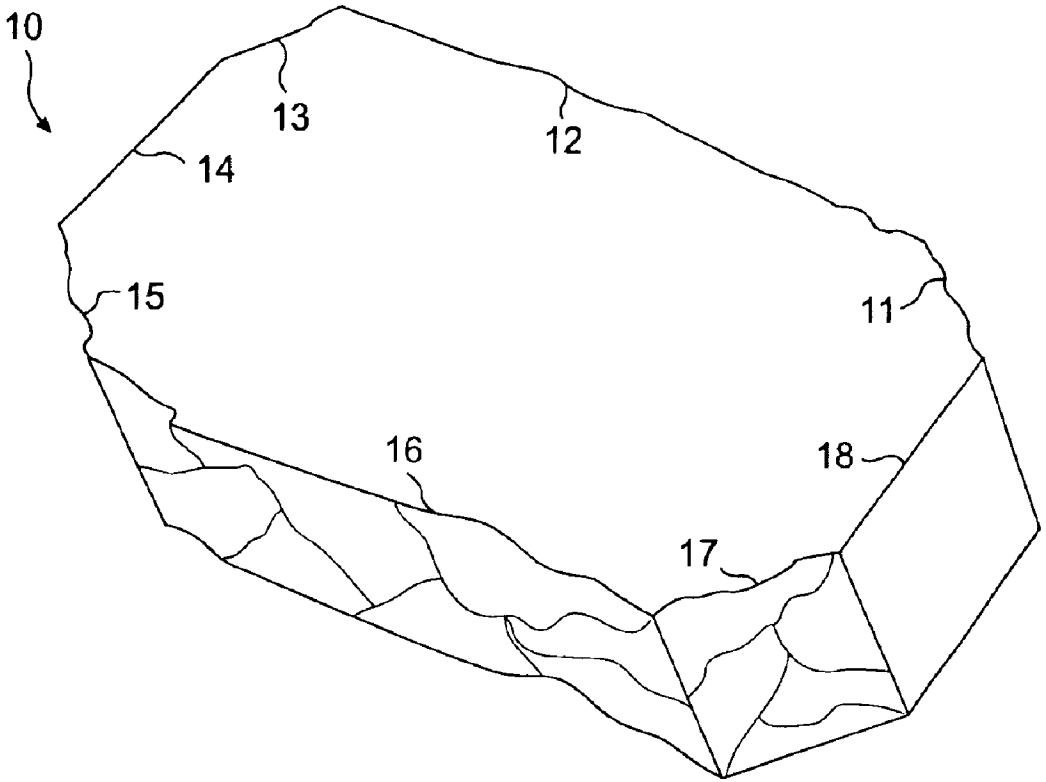
FIG. 1B is a perspective view of the block of FIG. 1A showing an opposite end thereof.
Figure 2:
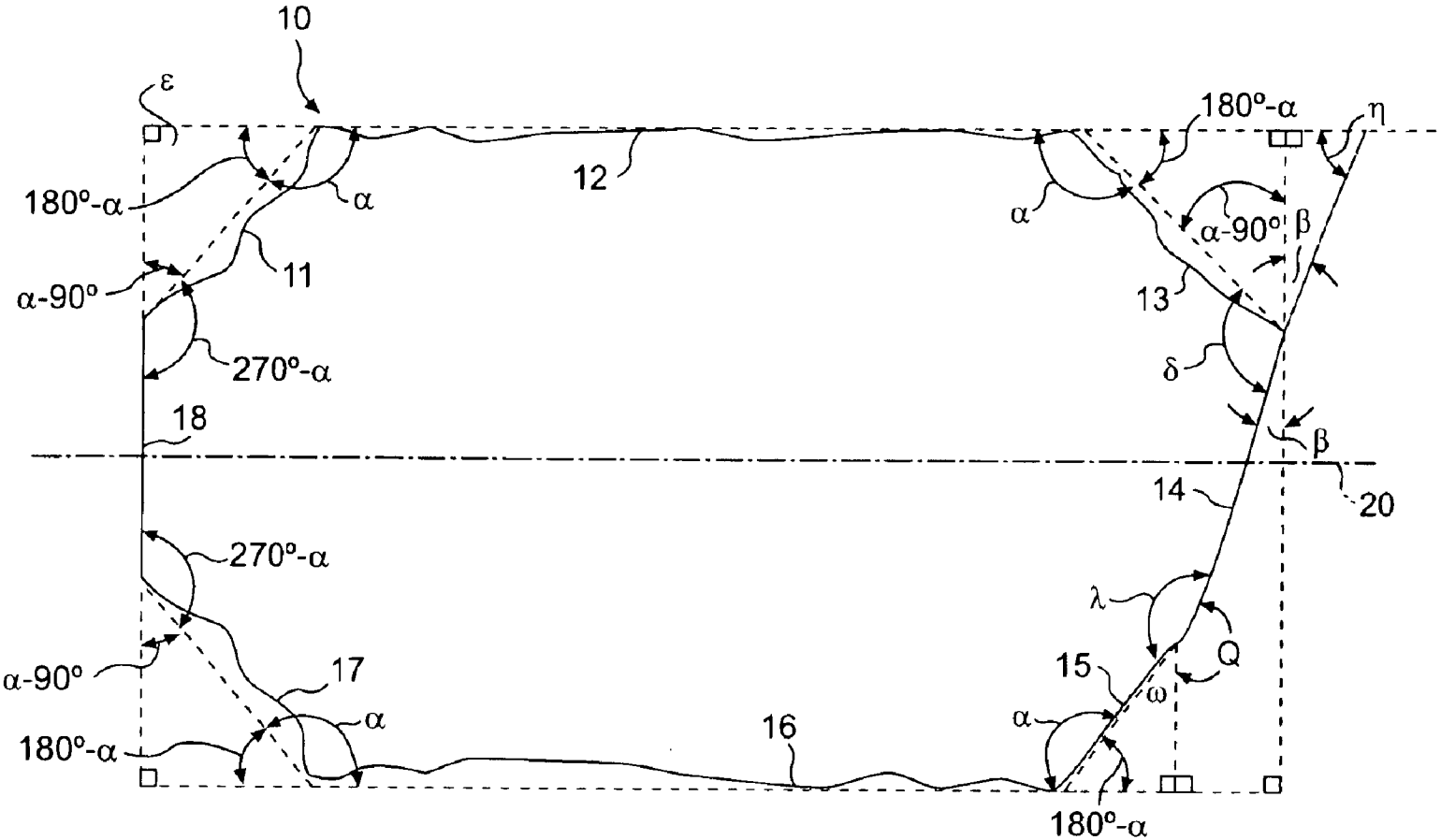
FIG. 2 is a top plan view of the block of FIGS. 1A and 1B showing the relative angles between the sides thereof.

The invention will now be discussed in detail with respect to the drawings. Referring to FIGS. 1A, 1B, and 2 a block 10 according to the present invention has top and bottom faces joined by eight sides 11–18. FIG. 2 shows the relative angles between the sides 11–18.

Although the sides 11–18 may be substantially planar in shape, they may also be rounded or roughened to provide a more natural appearance, as shown. It is preferable, however, for at least the end faces 14, 18 to be substantially planar to facilitate placing more than one block 10 end-to-end, as later described in detail.

It is preferable for the top and bottom faces of the block 10 to be similar in appearance so that the block 10 may be used in an inverted position, if desired. In addition, if the end-user does not intend to stack the blocks 10 on top of each other, the top and bottom faces of the block 10 could be rounded such that the second side 12 and the sixth side 16 form part of the same surface (which may be cylindrical); whichever face (top or bottom) will be adjacent the ground can be buried slightly so that the rounded portion thereof is in the ground.

As shown in FIG. 2, the first side 11 joins the second side 12 in an angle of $\alpha°$. The second side 12 joins the third side 13 in an angle of $\alpha°$. The third side 13 joins the fourth side 14 in an angle of $\delta°$. The fourth side 14 joins the fifth side 15 in an angle of $\lambda°$. The fifth side 15 joins the sixth side 16 in an angle of $\alpha°$. The sixth side 16 joins the seventh side 17 in an angle $\alpha°$. The seventh side 17 joins the eighth side 18 in an angle of $(270°-\alpha°)$. And, the eighth side 18 joins the first side 11 in an angle $(270°-\alpha°)$.

As will hereafter be explained in detail, the various angles between the sides 11–18 have the following association: $\lambda°+\delta°+2(\alpha°)=540°$. The following geometric analysis will be understood with respect to FIG. 2:

$90°+90°+Q°+\beta°=360°$, which can be resolved to be Equation No. 1:

$Q°+\beta°=180°$. Equation No. 2:

$(180°-\alpha°)+\omega°+90°=180°$, which can be resolved to be Equation No. 3:

$\omega°=\alpha°-90°$. Equation No. 4:

$\beta°+\delta°+(\alpha°-90°)=180°$, which can be resolved to be Equation No. 5:

$\beta°=270°-\delta°-\alpha°$. Equation No. 6:

Substituting Equation No. 6 into Equation No. 2 yields:

$Q°+(270°-\delta°-\alpha°)=180°$, which can be resolved to be Equation No. 7:

$Q°=\delta°+\alpha°-90°$. Equation No. 8:

$\lambda°+Q°+\omega°=360°$. Equation No. 9:

Substituting Equation Nos. 4 and 8 into Equation 9 yields:

$\lambda°+(\delta°+\alpha°-90°)+(\alpha°-90°)=360°$, which can be resolved to be Equation No. 10:

$\lambda°+\delta°+2(\alpha°)=540°$. Equation No. 11:

In one embodiment of the block 10, $\alpha°=140°$. As a result, the fifth side 15 joins the sixth side 16 in a angle of 140°, the sixth side 16 joins the seventh side 17 in an angle of 140°, the seventh side 17 joins the eighth side 18 in an angle of 130°, the eight side 18 joins the first side 11 in an angle of 130°, the first side 11 joins the second side 12 in an angle of 140°, and the second side 12 joins the third side 13 in an angle of 140°. If $\delta°=115°$, the third side 13 joins the fourth side 14 in an angle of 115° and the fourth side 14 joins the fifth side in an angle of 145°.

In another embodiment, if all sides 11–18 were of equal length and if $\alpha°=135°$ (such that $\lambda°+\delta°=270°$), to avoid the creation of a perfect octagon (which would not work to create a curved wall as later described in detail), $\lambda°$ mmust not be equal to $\delta°$, i.e., $\lambda°$ and $\delta°$ should not also be 135°.

For reasons which will later become more clear, to facilitate placing more than one block 10 end-to-end to create a curved wall, it is preferable that the lengths of the fourth side 14 and the eighth side 18 be substantially equal. In addition, to facilitate placing more than one block 10 end-to-end to create a straight wall, it is preferable that the second side 12 and the sixth side 16 be substantially parallel to each other and to a medial plane 20 of the block 10.

In the embodiment shown in FIG. 2, the second side 12 and the sixth side 16 (which may be substantially equal in length) are preferably oriented substantially perpendicular to the eighth side 18 (i.e., they are oriented with respect to the eighth side 18 at an angle of about $\epsilon°=90°$). By way of contrast, the second side 12 and the sixth side 16 are preferably not oriented perpendicular to the fourth side 14. Rather, the second side 12 and the sixth side 16 are oriented at an angle $\eta°$ with respect to the medial plane 20, where $\eta°+\beta°+90°=180°$ and where $\eta°\neq\epsilon°$. It should be readily apparent, however, that in other embodiments of the block 10, the second side 12 and the sixth side 16 may not be substantially perpendicular to the eighth side 18, so long as the fourth side 14 and the eighth side 18 are oriented at different angles with respect to the second side 12 and the sixth side 16; this embodiment of the block 10 may be used to create a wall having curved portions formed of a variety of angles between adjacent blocks 10.

Figure 3A:
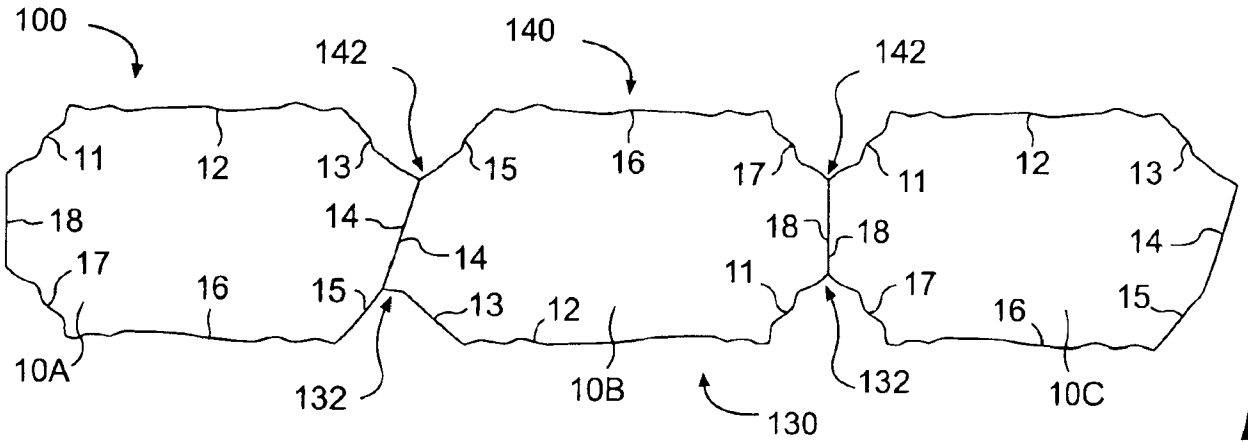
FIG. 3A is a top plan view of three blocks of the type shown in FIGS. 1A and 1B abutting end-to-end to create a straight wall.
Figure 3B:
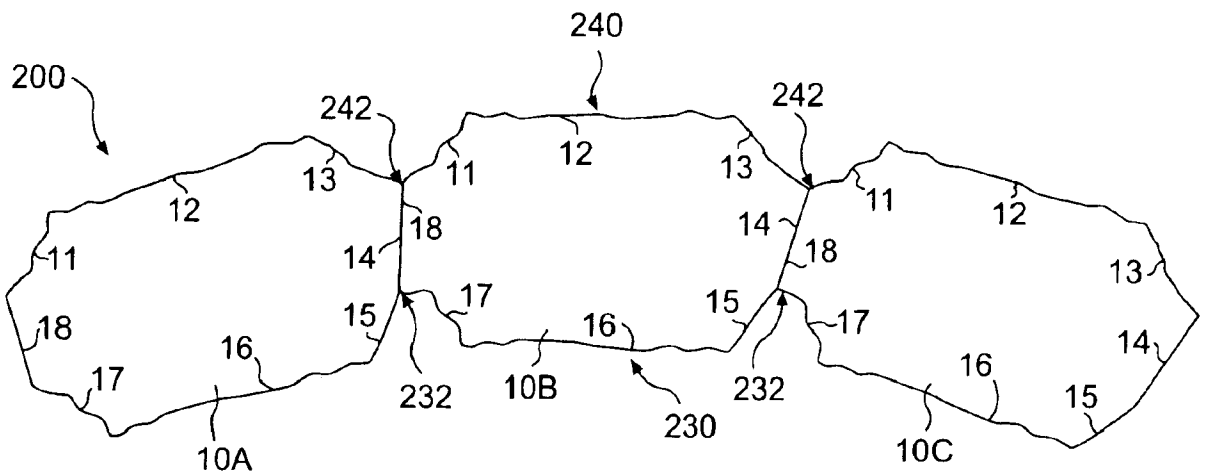
FIG. 3B is a top plan view of three blocks of the type shown in FIGS. 1A and 1B abutting end-to-end to create a curved wall.

Two or more blocks 10 can be oriented end-to-end to create a straight wall 100 (as shown in FIG. 3A) or a curved wall 200 (as shown in FIG. 3B). With respect to FIG. 3A, there is shown a first block 10A, a second block 10B, and a third block 10C. The first block 10A and the second block 10B are abutted end-to-end such that the fourth side 14 of the first block 10A abuts the fourth side 14 of the second block 10B. Similarly, the eighth side 18 of the second block 10B abuts the eighth side 18 of the third 10C block.

In this orientation, a straight wall 100 formed by the three blocks 10A, 10B, 10C has a front side 130 and a rear side 140. Grooves 132 are provided in the front side 130 of the straight wall 100 between the first block 10A and the second block 10B and between block the second block 10B and the third block 10C. Similarly, grooves 142 are provided in the rear side 140 of the straight wall 100 between the first block 10A and the second block 10B and between the second block 10B and the third block 10C. The grooves 132 in the front side 130 of the wall 100 are substantially the same in appearance as the grooves 142 in the rear side 140 thereof. As a result, the overall appearance of the front side 130 of the straight wall 100 is substantially similar to the overall appearance of the rear side 140 thereof.

Substantial similarity in appearance of the front 130 and rear 140 sides of the straight wall 100 can be maintained when creating the curved wall 200 shown in FIG. 3B. In this arrangement, the fourth side 14 of the first block 10A abuts the eighth side 18 of the second block 10B. Similarly, the fourth side 14 of the second block 10B abuts the eighth side 18 of the third block 10C. As the fourth sides 14 abut the eighth sides 18 in this arrangement and as previously mentioned, it is preferable that the fourth sides 14 and the eighth sides 18 have lengths which are substantially the same.

Similar to the straight wall 100, the front side 230 of the curved wall 200 has grooves 232 defined between the first block 10A and the second block 10B and between the second block 10B and the third block 10C. Moreover, the rear side 240 of the curved wall 200 has grooves 242 defined between the first block 10A and the second block 10B and between the second block 10B and the third block 10C. The size of the grooves 232 in the front side 230 of the wall 200 is not identical to the size of the grooves 242 in the rear side 240 thereof. However, as both sets of grooves 232, 242 are wedge-shaped, the appearance of the grooves 232 in the front side 230 of the wall 200 is substantially similar to the appearance of the grooves 242 in the rear side 240 thereof. As a result, the overall appearance of the front side 230 of the curved Wall 200 is substantially similar to the overall appearance of the rear side 240 thereof.

Figure 4:
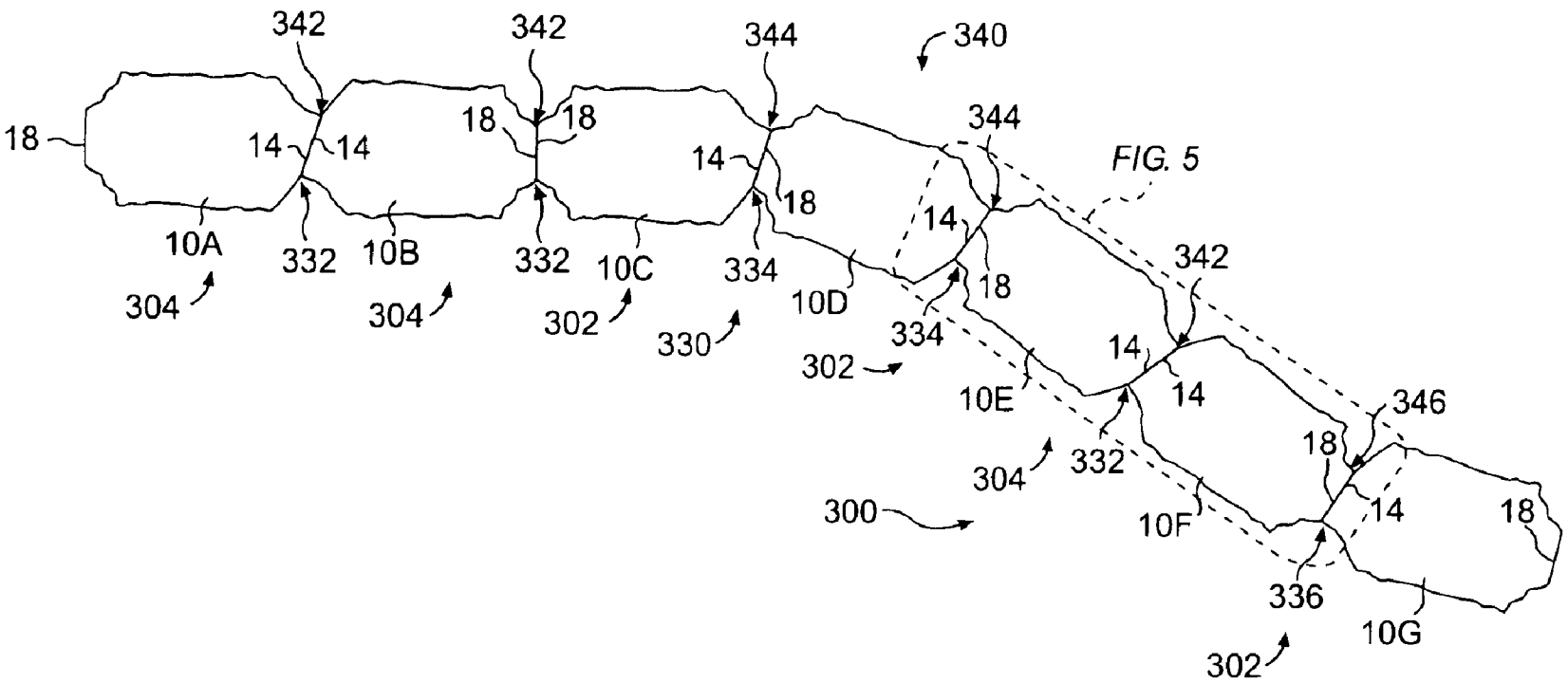
FIG. 4 is a top plan view of a plurality of blocks of the type shown in FIGS. 1A and 1B abutting end-to-end to create a wall having a curved portion and a straight portion.
Figure 5:
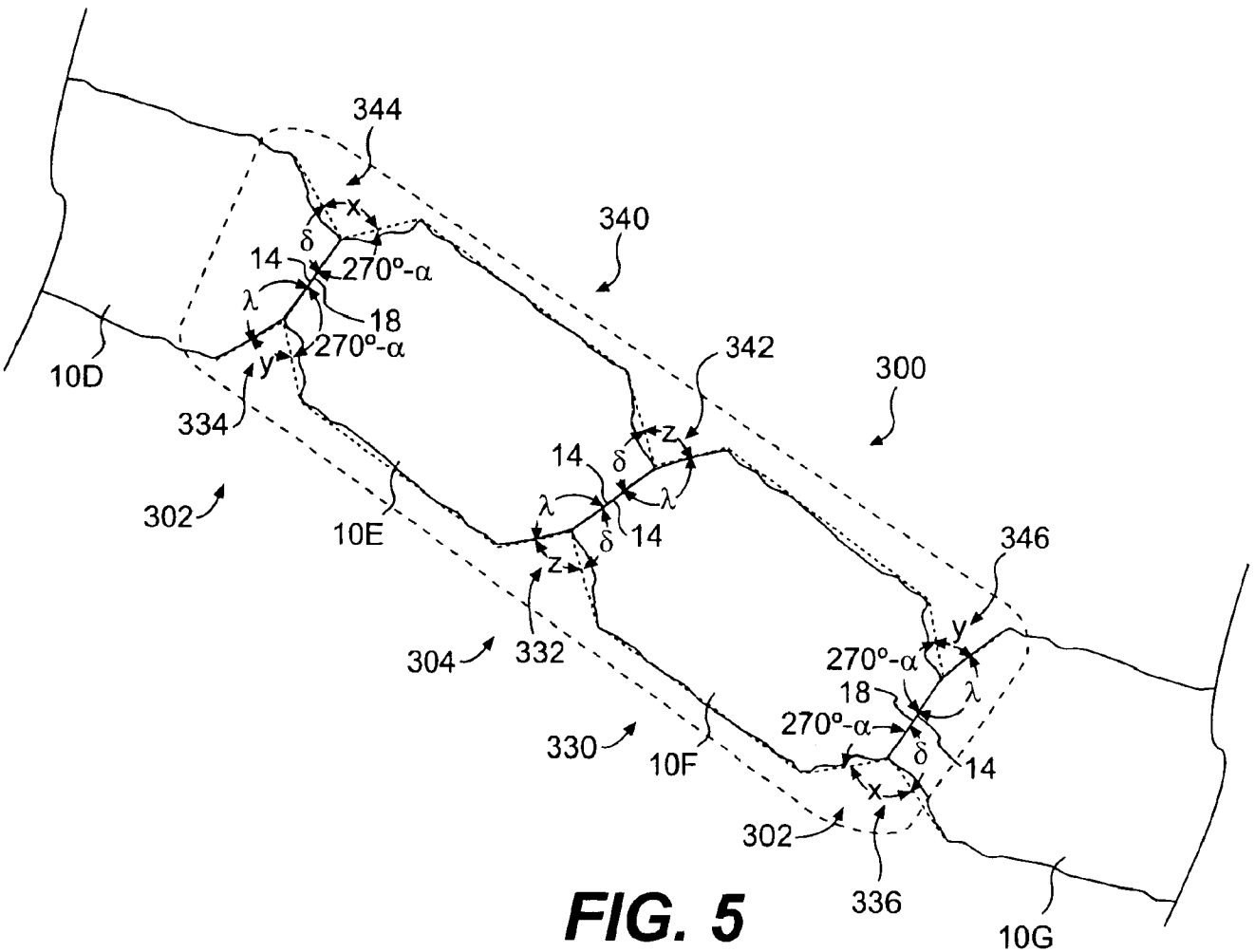
FIG. 5 is a top plan view of a portion of the wall of FIG. 4.
Figure 6:
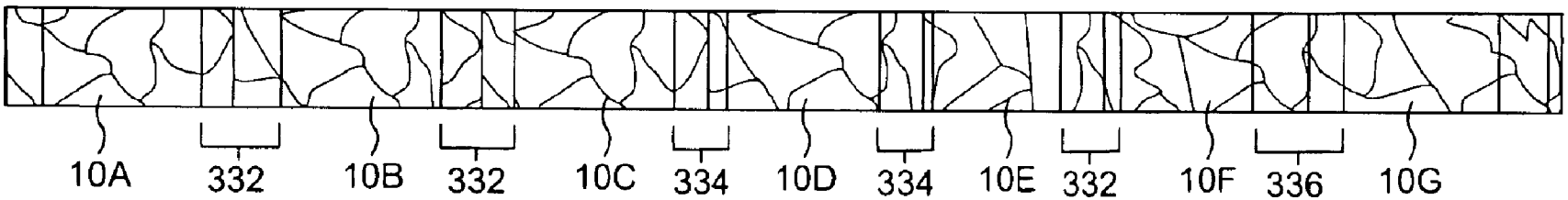
FIG. 6 is a front elevational view of the wall of FIG. 4.
Figure 7:
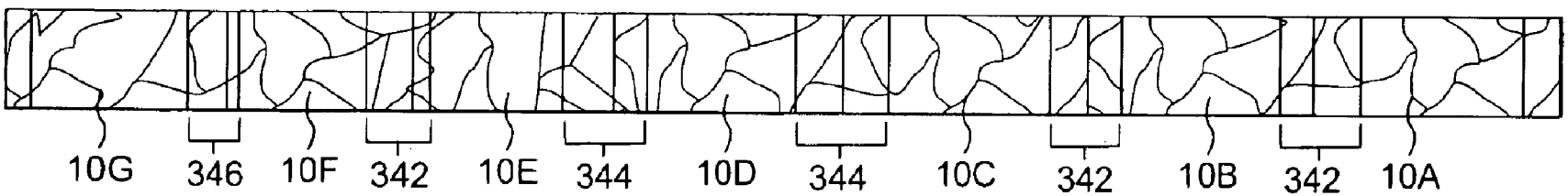
FIG. 7 is a rear elevational view of the wall of FIG. 4.

Referring to FIGS. 4–7, a wall 300 having curved portions 302 and straight portions 304 is made of a plurality of blocks 10A–10G of the type shown in FIGS. 1A and 1B abutting end-to-end. FIG. 5 shows details of this arrangement, while FIGS. 6 and 7 show the appearance of the wall 300 viewed from the front and rear, respectively.

As shown in FIG. 4, three types of grooves 332, 334, 336 are formed in the front side 330 of the wall 300. The first type of groove 332 is formed between adjacent blocks which are linearly arranged, e.g., between block 10A and block 10B, between block 10B and block 10C, and between block 10E and block 10F. A second type of groove 334 is formed where two adjacent blocks are arranged to form a concave curve, e.g., between block 10C and block 10D and between block 10D and block 10E. Finally, the third type of groove 336 is formed between two adjacent blocks arranged to form a convex curve, e.g., between block 10F and block 10G. Although the three types of grooves 332, 334, 336 may not be identical in size, they are substantially similar in appearance as they are all wedge-shaped, as later described with respect to FIG. 5.

Similar to the front side 330, three types of grooves 342, 344, 346 are formed in the rear side 340 of the wall 300. The first type of groove 342 is formed between adjacent blocks which are linearly arranged, e.g., between block 10A and block 10B, between block 10B and block 10C, and between block 10E and block 10F. A second type of groove 344 is formed where two adjacent blocks are arranged to form a concave curve, e.g., between block 10C and block 10D and between block 10D and block 10E. Finally, the third type of groove 346 is formed between two adjacent blocks arranged to form a convex curve, e.g., between block 10F and block 10G. Although the three types of grooves 342, 344, 346 may not be identical in size, they are substantially similar in appearance as they are all wedge-shaped. Moreover, the appearance of the rear grooves 342, 344, 346 is substantially similar to the appearance of the front grooves 332, 334, 336. As a result, the overall appearance of the front side 330 of the wall 300 is substantially similar to the overall appearance of the rear side 340 thereof.

The relative sizes of the grooves 332, 334, 336, 342, 344, 346 shown in FIG. 4 are shown in greater detail in FIG. 5. FIG. 5 shows that grooves 334, 346 satisfy an equation (Equation No. 12), that grooves 332, 342 satisfy an equation (Equation No. 13), and that grooves 336, 344 satisfy an equation (Equation No. 14), as follows:

$$\lambda^\circ+(270^\circ-\alpha^\circ)+Y=360^\circ. \quad \text{Equation No. 12:}$$

$$\lambda^\circ+\delta^\circ+Z=360^\circ. \quad \text{Equation No. 13:}$$

$$(270^\circ-\alpha^\circ)+\delta^\circ+X=360^\circ. \quad \text{Equation No. 14:}$$

As previously mentioned, if $\delta^\circ=115^\circ$, $\lambda^\circ=145^\circ$, and $\alpha^\circ=140^\circ$, then $Y=85^\circ$, $Z=100^\circ$, and $X=115^\circ$. As a result, the interior angle of the wedge-shaped grooves 332, 334, 336, 342, 344, 346 varies by no more that about 30° (for this embodiment), thereby ensuring that the grooves are substantially similar in appearance. Moreover, as seen from FIGS. 6 and 7, grooves 332, 334, 336, 342, 344, 346 exist between each of the adjacent blocks 10A–10G regardless of whether the blocks are arranged linearly or arranged to create a concave or convex curve.

Finally, it should be readily apparent with respect to FIGS. 4–7, that a plurality of similarly shaped blocks 10 can be methodically positioned to create a wall 300 which has at least one straight portion 304 and at least one curved portion 302 and which has a front side 330 the appearance of which is substantially similar to the appearance of a rear side 340 thereof. In this method, a first block 10E is placed in a predetermined position. Thereafter, a second block 10F is placed adjacent the first block 10E in an end-to-end orientation thereby creating a first straight portion 304. Subsequently, a third block 10D/10G can be placed adjacent the first block 10E or the second block 10F in an end-to-end orientation thereby creating a first curved portion 302. As a result, the wall 300 will have three blocks (10D, 10E, 10F or 10E, 10F, 10G) which are arranged end-to-end defining a curved portion 302 and a straight portion 304. Moreover, it should be readily apparent that additional blocks 10 can be added (in a straight or curved fashion) to the wall 300 to increase its length. In addition, as end of the blocks 10D–10G are both formed of three sides (sides 17, 18, 11 and sides 12, 13, 14), the ends of the wall 300 will be substantially similar in appearance.

The invention is not limited to creating a landscaping wall. Rather, the blocks described herein may be used, for example, in masonry to create walls used to separate rooms within a structure. Accordingly, it should be understood that the apparatus and method described herein are illustrative only and are not limiting upon the scope of the invention, which is defined by the following claims.

What is claimed is:

1. A block comprising:

a first side;

a second side;

a third side;

a fourth side;

a fifth side;

a sixth side;

a seventh side; and an eighth side, wherein the first side joins the second side in an angle of $\alpha^\circ$, wherein the second side joins the third side in an angle of $\alpha^\circ$, wherein the third side joins the fourth side in an angle of $\delta^\circ$, wherein the fourth side joins the fifth side in an angle of $\lambda^\circ$, wherein the fifth side joins the sixth side in an angle of $\alpha^\circ$, wherein the sixth side joins the seventh side in an angle $\alpha^\circ$, wherein the seventh side joins the eighth side in an angle of $(270^\circ-\alpha^\circ)$, wherein the eighth side joins the first side in an angle $(270^\circ-\alpha^\circ)$, wherein $(\lambda^\circ+\delta^\circ+2(\alpha^\circ))=540^\circ$, and wherein $(270^\circ-\alpha^\circ)\neq\delta^\circ$.

2. The block according to claim 1, wherein the second side is substantially equal in length to the sixth side, and wherein the eighth side is substantially equal in length to the fourth side.

3. The block according to claim 1, wherein the eighth side is substantially perpendicular to the second and sixth sides.

4. The block according to claim 1, wherein the block is formed from a material selected from the group consisting of stone, brick, concrete, ceramic, and clay.

5. A block comprising:

a front face;

a rear face opposite the front face;

a right end comprising first, second, and third parts, the first part connected at an angle to the front face, the second part connected at an angle to the rear face, and the third part connecting the first and second parts, wherein the third part is oriented substantially perpendicular to the front and rear faces; and a left end comprising first, second, and third parts, the first part connected at an angle to the front face, the second part connected at an angle to the rear face, and the third part connecting the first and second parts, wherein the third part is oriented at an oblique angle to the front and rear faces, wherein the third part of the right end of a first block is adapted to abut the third part of the left end of a like second block so that the front faces of the first and second blocks are angled, so that the rear faces of the first and second blocks are angled, so that a first groove is defined between the first part of the right end of the first block and the first part of the left end of the second block, and so that a second groove is defined between the second part of the right end of the first block and the second part of the left end of the second block.

6. The block according to claim 5, wherein the third part of the right end of the first block is adapted to abut the third part of the right end of a like third block so that the front face of the first block is substantially aligned with the front face of the third block, so that the rear side of the first block is substantially aligned with the rear face of the third block, so that a third groove is defined between the first part of the right end of the first block and the first part of the right end of the third block, and so that a fourth groove is defined between the second part of the right end of the first block and the second part of the right end of the third block.

7. The block according to claim 6, wherein the first and second grooves have appearances which are substantially similar, and wherein the third and fourth grooves have appearances which are substantially similar.

8. The block according to claim 5, wherein the third part of the left end of the first block is adapted to abut the third part of the left end of a like third block so that the front face of the first block is substantially aligned with the rear face of the third block, so that the rear face of the first block is substantially aligned with the front face of the third block, so that a third groove is defined between the front first part of the left end of the first block and the second part of the left end of the third block, and so that a fourth groove is defined between the second part of the left end of the first block and the first part of the left end of the third block.

9. The block according to claim 8, wherein the first and second grooves have appearances which are substantially similar, and wherein the third and fourth grooves have appearances which are substantially similar.

10. The block according to claim 5, wherein the block is formed from a material selected from the group consisting of stone, brick, concrete, ceramic, and clay.

11. The block according to claim 5, wherein the front face is substantially parallel to the rear face.

12. The block according to claim 5, wherein the first and second grooves have appearances which are substantially similar.

13. An asymmetrical landscaping block for abutting end-to-end placement with like blocks, the block comprising:

a top face;

a bottom face;

a front face;

a rear face;

a left end; and a right end, wherein the left end comprises a first abutting face disposed at an angle $\delta$ with respect to a medial vertical plane through the left and right ends, wherein the right end comprises a second abutting face disposed at an angle $\eta$ with respect to the medial vertical plane, wherein $\epsilon \neq \eta$, wherein the first abutting face of the left end of a first block is adapted to abut the second abutting face of the right end of a like second block so that the front faces of the first and second blocks are angled, so that the rear faces of the first and second blocks are angled, so that a first groove is defined between the front face of the first block and the front face of the second block, and so that a second groove is defined between the rear face of the first block and the rear face of the second block.

14. The asymmetrical block according to claim 13, wherein the front face and the rear face are substantially parallel.

15. The asymmetrical block according to claim 14, wherein the first abutting face is substantially perpendicular to the front and rear faces.

16. The asymmetrical block according to claim 13, wherein the left end further comprises a first part which connects the first abutting face to the front face and a second part which connects the first abutting face to the rear face, and wherein the right end further comprises a first part which connects the second abutting face to the front face and a second part which connects the second abutting face to the rear face.

17. The asymmetrical block according to claim 16, wherein the first groove is defined between the first part of the left end of the first block and the first part of the right end of the second block, and wherein the second groove is defined between the second part of the left end of the first block and the second part of the right end of the second block.

18. The asymmetrical block according to claim 13, wherein the first abutting face is substantially equal in length to the second abutting face.

19. The asymmetrical block according to claim 18, wherein the front face is substantially equal in length to the rear face.

20. The asymmetrical block according to claim 13, wherein the block is formed from a material selected from the group consisting of stone, brick, concrete, ceramic, and clay.

21. The asymmetrical block according to claim 13, wherein the first and second grooves have appearances which are substantially similar.

22. A system for constructing a landscaping wall from a plurality of blocks, the system comprising:

a first block comprising:

a top face;

a bottom face;

a front face;

a rear face;

a left end; and a right end, wherein the left end comprises a first abutting face disposed at an angle $\epsilon$ with respect to a medial vertical plane through the left and right ends block, and wherein the right end comprises a second abutting face disposed at an angle $\eta$ with respect to the medial vertical plane, wherein $\epsilon \neq \eta$, and a second block substantially similar in shape to said first block, wherein the first abutting face of the left end of a first block is adapted to abut the second abutting face of the right end of the second block so that the front faces of the first and second blocks are angled, so that the rear faces of the first and second blocks are angled, so that a first groove is defined between the front face of the first block and the front face of the second block, and so that a second groove is defined between the rear face of the first block and the rear face of the second block.

23. The system according to claim 22, wherein the front and rear faces of the first block are substantially parallel to each other.

24. The system according to claim 23, wherein the first abutting face of the first block is substantially perpendicular to the front and rear faces of thereof.

25. The system according to claim 22, wherein the left end of each block further comprises a first part which connects the first abutting face to the front face and a second part which connects the first abutting face to the rear face, and wherein the right end of each block further comprises a first part which connects the second abutting face to the front face and a second part which connects the second abutting face to the rear face.

26. The system according to claim 25, wherein the first groove is defined between the first part of the left end of the first block and the first part of the right end of the second block, and wherein the second groove is defined between the second part of the left end of the first block and the second part of the right end of the second block.

27. The system according to claim 22, wherein the first abutting face and the second abutting face of each block are substantially equal in length.

28. The system according to claim 27, wherein the front face and the rear face of each block are substantially equal in length.

29. The system according to claim 22, wherein the first and second blocks are formed from a material selected from the group consisting of stone, brick, concrete, ceramic, and clay.

30. The system according to claim 22, wherein the first and second grooves have appearances which are substantially similar.

31. A method of constructing a wall having at least one straight portion and at least one curved portion, the method comprising the steps of:

placing a first block in a predetermined position;

placing a second block in an end-to-end orientation with respect to the first block to create a first of the at least one straight portion, said second block having a shape which is substantially the same as the first block; and placing a third block in an end-to-end orientation with respect to either the first or the second block to create a first of the at least one curved portion, said third block having a shape which is substantially the same as the first and second blocks, wherein a front side of a wall formed by the first, second, and third blocks has an appearance which is substantially similar to an appearance of a rear side of the wall formed by the first, second, and third blocks.

32. The method according to claim 31, wherein a first end of the wall has an appearance which is substantially similar to an appearance of a second end of the wall.

* * * * *